United States Patent [19]

Malinowski

[11] 4,249,169

[45] Feb. 3, 1981

[54] OPTICAL SMOKE DETECTOR

[76] Inventor: William J. Malinowski, Johnson St., P.O. Box 274, Bryantville, Mass. 02327

[21] Appl. No.: 40,110

[22] Filed: May 18, 1979

[51] Int. Cl.[3] ..... G08B 17/10

[52] U.S. Cl. ..... 340/630; 250/574; 356/439

[58] Field of Search ..... 340/627, 628, 630; 250/574; 356/439, 438

[56] References Cited

U.S. PATENT DOCUMENTS

| | | | |
|---|---|---|---|
| 3,315,244 | 4/1967 | Voigt et al. | 340/630 X |
| 3,383,670 | 5/1968 | Roberts | 340/630 |
| 3,555,532 | 1/1971 | White et al. | 340/630 |
| 3,922,655 | 11/1975 | Lecuyer | 340/630 |

FOREIGN PATENT DOCUMENTS

| | | | |
|---|---|---|---|
| 1172354 | 11/1969 | United Kingdom | 340/630 |

*Primary Examiner*—John W. Caldwell, Sr.
*Assistant Examiner*—Daniel Myer
*Attorney, Agent, or Firm*—Morse, Altman, Oates & Dacey

[57] ABSTRACT

A reflected light optical smoke detector includes a thermistor in series with a light emitting diode connected in parallel to a photo-resistive cell. Alarm circuitry is connected to the photocell having a voltage output which is a function of the presence or absence of smoke in an examination zone illuminated by the light source and visible to the cell. The circuit is temperature-compensated automatically by the thermistor since the thermistor will increase the current to the LED in the event of an increase of ambient temperature. The increase in the LED light output will compensate for the loss of photocell sensitivity in the event of an increase in temperature.

6 Claims, 2 Drawing Figures

OPTICAL SMOKE DETECTOR

BACKGROUND OF THE INVENTION

1. Field of the Invention

This invention relates generally to smoke detectors and more particularly is directed towards a new and improved, temperature-compensated, reflected light optical smoke characterized by a minimum number of components.

2. Description of the Prior Art

Conventional optical smoke detectors typically comprise one or more light sources operating in conjunction with one or more photocells with one light source often serving as a reference for comparison with the light output of the other sources. In an obscuration type detector smoke passing between one light source and a photocell visible to the source will reduce the output of the photocell and alarm circuitry, set to a predetermined voltage level output of the photocell, will be actuated. In a reflected light type of detector, the light source is directed at a zone that is visible to the cell. If smoke is present in the zone, light reflected from the smoke will fall on the cell, increasing its output. Alarm circuitry will again be actuated in the event of such an increase.

Insofar as many of the components in a smoke detector circuit are temperature sensitive, many detectors are provided with rather complex means to compensate for changes in ambient temperature. In general any increase in the complexity of the circuit adds to the cost of the circuit because of additional components and assembly requirements.

Accordingly, it is an object of the present invention to provide a simple, low cost, reflected light optical smoke detector characterized by a minimum number of components.

Another object of this invention is to provide a temperature-compensated, reflected light optical smoke detector having selected components with complementary temperature coefficients that automatically correct for changes in ambient temperatures.

A further object of this invention is to improve the reliability of smoke detectors by reducing the number of parts thereof.

SUMMARY OF THE INVENTION

This invention features a reflected light optical smoke detector comprising a light source directed at an examination zone and a photocell visible to the zone and having a voltage output related to the intensity of the light reflected onto the cell from smoke present in the zone. The cell output will vary according to the presence or absence of smoke in the zone. The photoresistive cell is also characterized by a positive temperature coefficient in that its impedance or resistance increases with temperature. The thermal operating characteristics of the cell are compensated for by means of a thermistor, having a negative temperature coefficient, in line with the light source. As the ambient temperature of the smoke detector system increases, the resistance of the thermistor will decrease, providing a greater light output for the light source. The increase in light reflected against the photocell from any smoke present in the zone thus compensates for the increasing resistance of the cell in the event of an increase in temperature.

Alarm circuitry is connected to the photocell for generating an alarm under the appropriate conditions.

BRIEF DESCRIPTIONS OF THE DRAWINGS

FIG. 1 is a schematic diagram of a reflected light optical smoke detecting circuitry made according to the invention, and, FIG. 2 is a graphical representation showing the resistance characteristics of the thermistor and cell circuit components under different temperature conditions.

DETAILED DESCRIPTION OF THE PREFERRED EMBODIMENT

Figure 1:
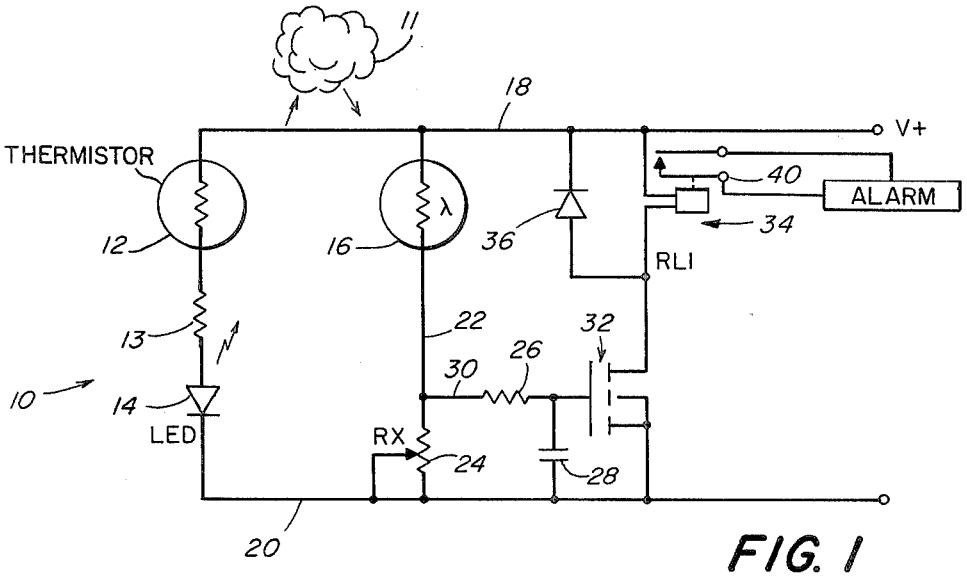

Referring now to the drawings, the reference character 10 generally indicates a reflected light optical smoke detector which typically would be mounted within an an appropriate housing (not shown) defining a chamber or zone through which smoke 11 or other aerosols may pass for detection purposes. The detector circuit is comprised of a thermistor 12 and a light source 14 positioned to illuminate the zone and connected across a photo-resistive cell 16 visible to the light zone. In practice the light source 14 is a light emitting diode which draws a small amount of current and is characterised by a light output that increases and decreases linearly with increases and decreases in current.

The thermistor 12 and LED 14 are connected between leads 18 and 20 with the lead 18 being connected to V+. A damping resistor 13 may be provided, if necessary, prior to the LED. The cell 16 also connects between leads 18 and 20 by means of a lead 22 with a potentiometer 24 in the lead 22 for adjusting the cell output. An optional noise filter comprised of a resistor 26 and capacitor 28 also may be provided between the lead 22 and the lead 20 through a lead 30 connected to the output side of the cell 16.

Also connected to the lead 30 is a voltage responsive device 32 adapted to close in the event that the resistance of the cell 16 exceeds a predetermined level. When the device 32 closes, a relay circuit 34 comprised a diode 36 and a relay coil 38 in parallel is energized to close a relay switch 40. The switch 40, in turn, connects to a central station where an alarm device will be actuated. In practice, the device 32 may be a power field effect transistor or V mos.

Insofar as most standards in the smoke detector industry define V− as a voltage +10%−15% of a standard value, such as 6, 12 and 24 volts, the thermistor 12 is selected such that at a given V+, the current of the light emitting diode 14 will be approximatley equal to 5 Ma.

Figure 2:
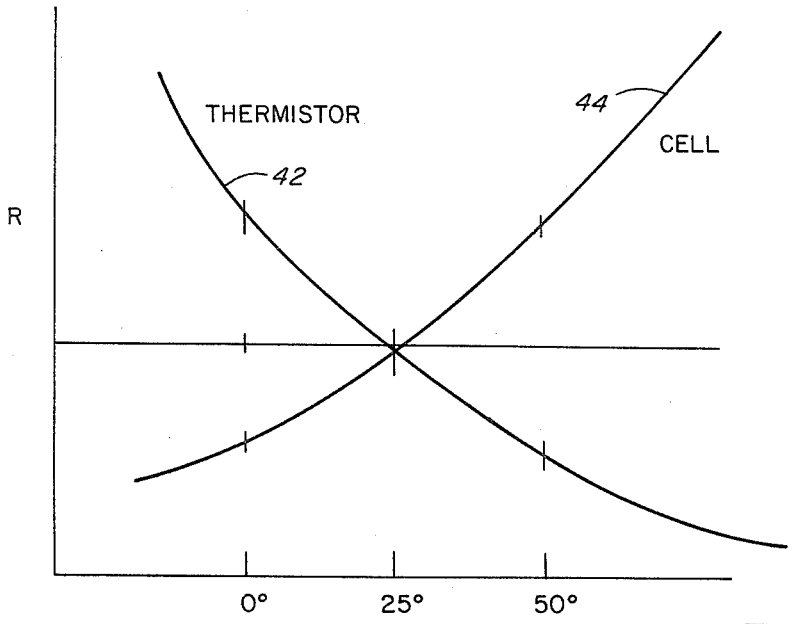

As shown in FIG. 2, the resistance of the thermistor 12, represented by a curve 42, decreases with an increase in temperature so that the current through the thermistor will increase as ambient temperature rises. Conversely, with a decrease in temperature the resistance of the thermistor will increase. With an increase in ambient temperature, more current will pass through the thermistor to drive the LED 14 and with a decrease in temperature less current will pass. The increase in current through the thermistor 14 will increase the brightness of the LED which will compensate for the loss in the sensitivity of the photocell 16 when the ambient temperature increases. The light output of the LED 14 decreases with an increase in temperature although its output is not as temperature sensitive as that of the cell 16. The light output will increase and decrease linearly under increases and decreases in applied current.

As is also shown in FIG. 2, the resistance or impedance characteristics of the cell 16 is represented by a curve 44, indicating an increase in resistance with an increase in ambient temperature. Thus, within normal operating temperature levels, any increase in the resistance of the cell upon a rise in temperature will be offset by a decrease in the resistance of the thermistor producing an increase in the LED output. A thermally compensated optical smoke detector of a minimum number of components is thereby provided.

In place of the V mos device 32 a darlington device may be utilized to advantage. The circuit configuration eliminates customary internal regulation for this type of circuit and the sensitivity of the circuit varies according to supply variations.

Under normal conditions the smoke examination zone will be clear and light from the LED 14 will not reflect onto the cell 16. Thus, there will be little or no output from the cell because of its high impedance. However, if smoke 11 appears in the zone, light from the LED 14 will reflect against the smoke and onto the cell 16. This will reduce the impedance of the the cell 16 and thereby actuate the device 32. Any change in the operating impedance characteristics of the cell 16 due to thermal conditions are automatically offset by the output of the LED 14 under the control of the thermistor 12. At the same time any reduction in the light output of the LED 14 due to a rise in temperature is also corrected by an increase in current through the thermistor.

In practice it has been found that a photocell fabricated from cadmium sulfide produces the desired characteristics which are offset by the operating characteristics of the thermistor. Any other photo-responsive device having resistance characteristics similar to that of the cadmium sulfide device may be utilized.

While the invention has been described with particular reference to the illustrated embodiment, numerous modifications thereto will appear to those skilled in the art.

Having thus described the invention, what I claim and desire to obtain by Letters Patent of the United States is:

1. An optical smoke detector, having an examination zone through which smoke is adapted to pass, comprising (a) a light source in position to illuminate said zone and any smoke therein, (b) a photo-resistive light detecting cell visible to said zone and electrically connected in parallel circuit to said light source, said cell characterized by a temperature coefficient that increases the resistance of said cell with an increase in ambient temperature and decreases the resistance of said cell with an increase in ambient temperature, (c) a resistance element electrically connected in series with and on the input side of said source and characterized by a temperature coefficient that decreases the resistance of said element with an increase in ambient temperature and increases the resistance of said element with a decrease in ambient temperature, and, (d) alarm means including a voltage responsive switching device operatively connected to said light detecting cell on the output side thereof and adapted to generate an alarm when the resistance of said light detecting cell exceeds a predetermined level, (e) said light source being a monochromatic light emitting diode characterized by a light output that increases and decreases linearly with increases and decreases in applied current.

2. An optical smoke detector according to claim 1 wherein said element is a thermistor.

3. An optical smoke detector according to claim 2 wherein said light detecting means includes a cadmium sulfide cell.

4. An optical smoke detector according to claim 3 wherein said alarm means includes a field effect transistor responsive to the resistance change of said cell.

5. An optical smoke detector according to claim 3 including a potentiometer connected to the output side of said cell.

6. An optical smoke detector according to claim 3 including noise filtering means connected between the output side of said cell and the input side of said alarm means.

* * * * *